United States Patent [19]

Kline et al.

[11] Patent Number: 4,515,069

[45] Date of Patent: May 7, 1985

[54] CHANGE-OVER DIFFUSER

[75] Inventors: James R. Kline, Moraga; Peter Brand, San Francisco, both of Calif.

[73] Assignee: Acutherm, Ltd., Emeryville, Calif.

[21] Appl. No.: 572,688

[22] Filed: Jan. 20, 1984

[51] Int. Cl.[3] ..... F24F 13/072

[52] U.S. Cl. ..... 98/40 D; 98/40 VT; 236/48 R

[58] Field of Search ..... 98/40 R, 40 D, 40 VT, 98/40 C, 41 R; 236/48 R

[56] References Cited

U.S. PATENT DOCUMENTS

| | | | |
|---|---|---|---|
| Re. 30,953 | 6/1982 | Vance et al. | 236/49 |
| 3,117,723 | 1/1964 | Church | 236/49 |
| 3,143,292 | 8/1964 | Church et al. | 236/49 |
| 3,353,473 | 11/1967 | Oneson et al. | 98/40 D |
| 3,412,669 | 11/1968 | Averill | 98/40 D |
| 3,848,799 | 11/1974 | Day | 98/40 D X |
| 4,026,465 | 5/1977 | Kenny | 236/48 R |

FOREIGN PATENT DOCUMENTS

| | | | |
|---|---|---|---|
| 737722 | 6/1980 | U.S.S.R. | 98/40 D |

*Primary Examiner*—Harold Joyce

*Attorney, Agent, or Firm*—Manfred M. Warren; Robert B. Chickering; Glen R. Grunewald

[57] ABSTRACT

A thermally powered change-over diffuser is disclosed which includes a housing having an outlet and movable blade assembly mounted with respect to the outlet for displacement between a first position producing a Coanda flow across a surface, such as a ceiling, and a second position producing a detached stream in a generally normally extending direction with respect to the surface. The diffuser is preferably thermally powered and includes a rapid change-over assembly enabling substantially immediate shifting between the two positions so as to provide a cooling mode of discharge and heating mode of discharge. Additionally, means for adjusting the volume of air discharged is provided.

4 Claims, 4 Drawing Figures

CHANGE-OVER DIFFUSER

BACKGROUND OF THE INVENTION

The present invention relates, in general, to the air distribution units and, more particularly, relates to ceiling mounted, thermally-powered, linear, change-over diffusers for use in air conditioning systems.

The use of air distribution units or diffusers as part of an air conditioning system for large structures is widespread. Such systems typically include a plurality of ceiling mounted diffusers which are supplied from a central source with either hot or cold air, depending upon temperature within the structure as sensed by control apparatus. One type of diffuser which is commonly employed is the linear diffuser which can be mounted proximate the perimeter walls or periphery of the space being heated or cooled.

Whether linear or non-linear diffusers are employed, it is well known that the most effective manner distributing air from diffusers during cooling is to direct the air in a horizontal flow across the ceiling of the room by employing what is known in the industry as the "Coanda effect". A stream of air discharged from a diffuser at an angle less than about 35 to about 40 degrees with respect to the ceiling will tend to create a partial vacuum and cause the air stream to remain in contact with or hug the ceiling as a result of the Coanda effect. Cool air, therefore, can be distributed over a substantial area of the ceiling by employing the Coanda effect before the cool air begins to sink down into the room to cool the entire volume of the room. By contrast, best efficiency in connection with the distribution of hot air from a perimeter diffuser is for the air to be discharged in a generally vertically oriented stream which is detached from the ceiling and oriented for flow of the warm air downwardly over the walls and windows of the structure. Additionally, it is also well known that in well insulated buildings in most climates the volume of warm air needed to raise the temperature in a structure is usually less than the volume of cool air flow required during cooling.

Diffusers or air distribution units have been previously developed which include movable blades, vanes or bladders which allow modulation and/or off-on control of air supplied through the diffuser. Such prior art diffusers have been thermally powered, for example as is disclosed in U.S. Pat. No. Re. 30,953. The diffuser of U.S. Pat. No. Re. 30,953 employs a movable louvre or blade system in which the blades are moved across a discharge outlet by a thermally powered actutator of the type commonly used in automotive applications. U.S. Pat. Nos. 3,117,723 and 3,143,292, by contrast, disclose air distribution units in which a bladder is used to control volume discharged from the diffuser by a pneumatic controller. In each case, the above referenced prior art air distribution apparatus employs discharge outlet and control vanes or bladders which produce air flow in substantially the same direction, namely, along the ceiling of the structure being air conditioned. While air flow volume is modulated by such apparatus, no attempt has been made to vary the direction of air flow.

OBJECTS AND SUMMARY OF THE INVENTION

A. Objects Of The Invention

Accordingly, it is an object of the present invention to provide a diffuser for an air conditioning system which is formed to enable variation of the direction of air discharged from the diffuser to maximize effectiveness of the diffusion of such air to the surrounding air into which it is discharged.

Another object of the present invention is to provide a diffuser for an air conditioning system of the like which is formed for distribution of air along a surface in a Coanda effect as well as downwardly from such surface in a detached stream.

Another object of the present invention is to provide a change-over assembly for a diffuser for an air conditioning system which can be powered, thermally, electrically, pneumatically or hydraulicly.

It is a further object of the present invention to provide a thermally-powered linear diffuser in which a changeover between heating and cooling modes automatically produces a change in the direction in which air is discharged from the diffuser.

Still a further object of the present invention is to provide a thermally-powered, change-over diffuser for an air conditioning system or the like in which a change in discharge direction between a cooling mode and a heating mode can be rapidly accomplished at selected predetermined temperatures.

Still a further object of the present invention is to provide a change-over diffuser for an air conditioning system or the like in which the air volume discharged in a heating mode and a cooling mode can be varied.

The change-over diffuser of the present invention has other objects and features of advantage which will become apparent from and are set forth in more detail in the accompanying drawing and the following description of the preferred embodiment.

B. Summary Of The Invention

The change-over diffuser of the present invention includes a housing formed for coupling to an air supply and formed with an outlet for discharge of air therefrom. Blade means are movably mounted with respect to the housing, and blade displacement means are also provided and coupled to the blade means for displacement of the blade means between two positions for control of air discharged from the outlet. The invention in the change-over diffuser comprises, briefly, the blade means being formed for discharge of air when the blade means is in a first position primarily along one side of the blade means at a first angle of discharge with respect to the outlet means, and the blade means being further formed for discharge of air from the outlet when the blade means is in a second position primarily along an opposite side of the blade means at a second angle of discharge displaced from the first angle. Preferably the blade means is provided as a pair of relatively spaced apart blades which are pivotally mounted for movement with respect to an elongated slot-like outlet with air being discharged primarily over one of the blades in the first position to produce Coanda effect flow over an adjacent surface and primarily over the other blade in the second position to produce a detached flow with respect to such surface. Most preferably, the blades are displaced by thermally-powered actuator, and the blades are in the first position for cooling to produce a Coanda effect flow over a ceiling, and are in the second position for near vertical flow down along a wall or window during heating. The diffuser apparatus further includes a rapid change-over assembly formed to cause the blades to shift between the first and second positions very rapidly so that the change-over between cooling and heating is quickly accomplished without the discharge of air obliquely into the structure in a manner which is undesirable.

DESCRIPTION OF THE PREFERRED EMBODIMENT

The diffuser of the present invention is primarily intended for use as a ceiling-mounted, linear diffuser for the heating and cooling of large buildings. As will be appreciated, however, the diffuser of the present invention may have numerous other applications in which air or other fluids need to be discharged into a volume for various pusposes. Thus, the diffuser can be mounted in a vertical wall and the diffuser blades can be displaced and powered by thermal, electrical, pneumatic or hydraulic means.

Figure 1:
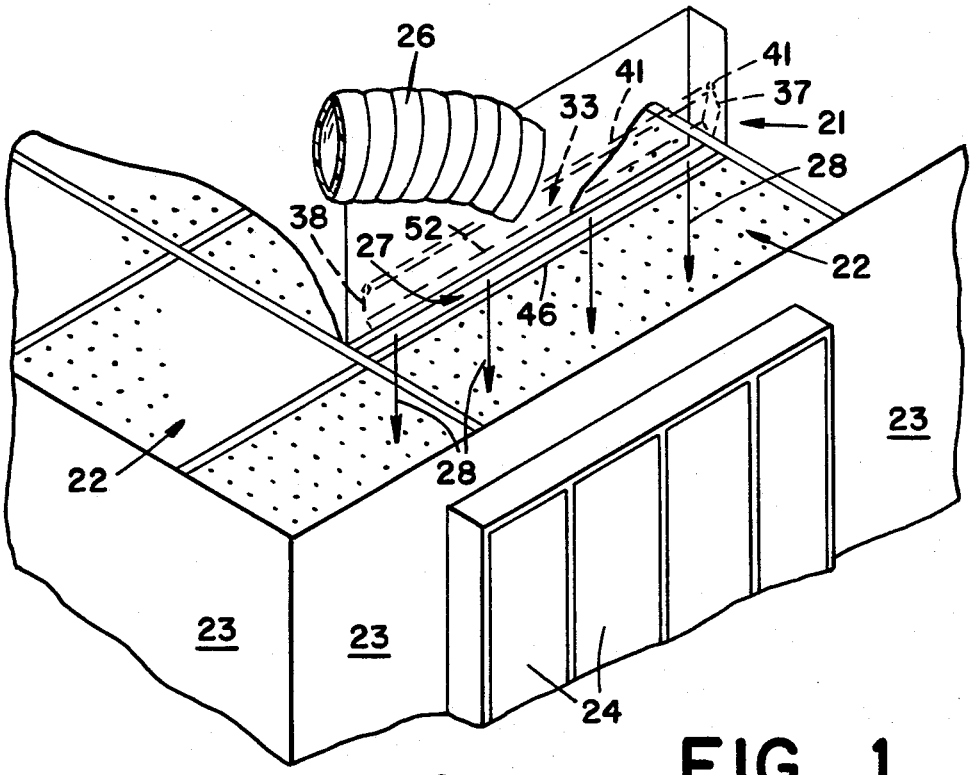
FIG. 1 is a bottom perspective view of a structure having a change-over diffuser constructed in accordance to the present invention and installed therein.
Figure 4:
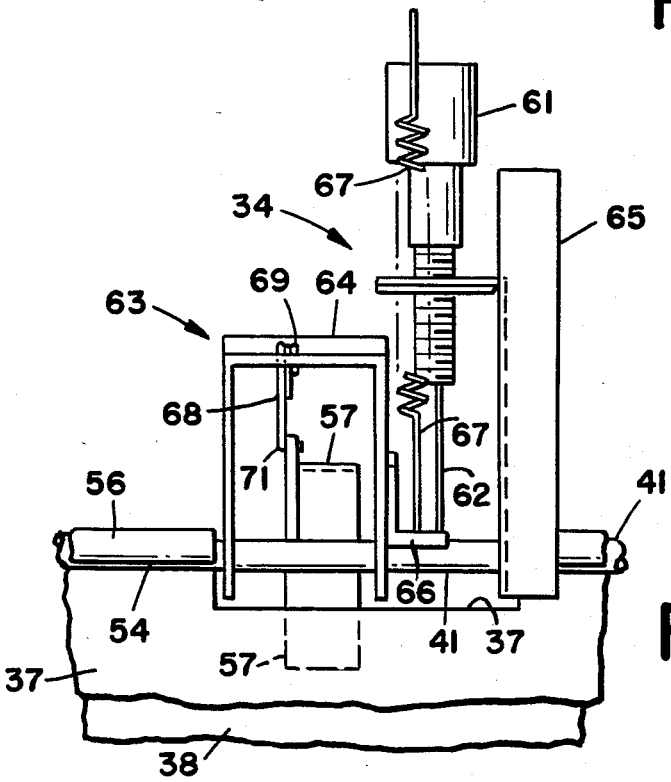
FIG. 4 is a fragmentary, side elevational view, taken substantially along the plane of line 4—4 in FIG. 3, of the thermally-powered, rapid change-over assembly of the diffuser of the present invention.

In FIG. 1, a diffuser, generally designated 21, is shown mounted in the ceiling 22 of a room proximate vertical walls 23 and windows 24. Coupled to diffuser 21 is an air supply conduit 26, and the diffuser is a linear perimeter diffuser having an elongated outlet means, generally designated 27, from which air is discharged, as indicated by arrows 28. The direction of air discharge indicated by arrows 28 approximates the direction of discharge when the diffuser is in a heating mode, as will be more fully described hereinafter.

Broadly speaking, diffuser 21 includes elements which are well known in the prior art. As best may be seen in FIGS. 2 and 3, diffuser 21 includes a housing 31 formed for coupling to air supply means, such as conduit 26. A collar 32 can be provided on the housing for receipt of conduit 26 thereover. Housing 31 is also formed with outlet means 27 for the discharge of air from the housing into the room. Movably mounted within housing 31 is blade means, generally designated 33, which extends longitudinally along the length of outlet means 27 and is formed to cooperate with outlet means 27 for the control of air discharged from the outlet. Finally, the diffuser of the present invention includes blade displacement means, generally designated 34, coupled to blade means 33 for displacement of the blade means between a first position and a second position, as will be more fully described hereinafter.

In order to enable enhanced efficiency in the discharge of air from the diffuser of the present invention, the diffuser is constructed with improved blade means which are formed to effect a change in the direction of flow of air discharged during movement between the first and second positions. This change in the direction of flow is also normally, but not necessarily accompanied by a change of the operating mode of the diffuser between heating and cooling.

Figure 2:
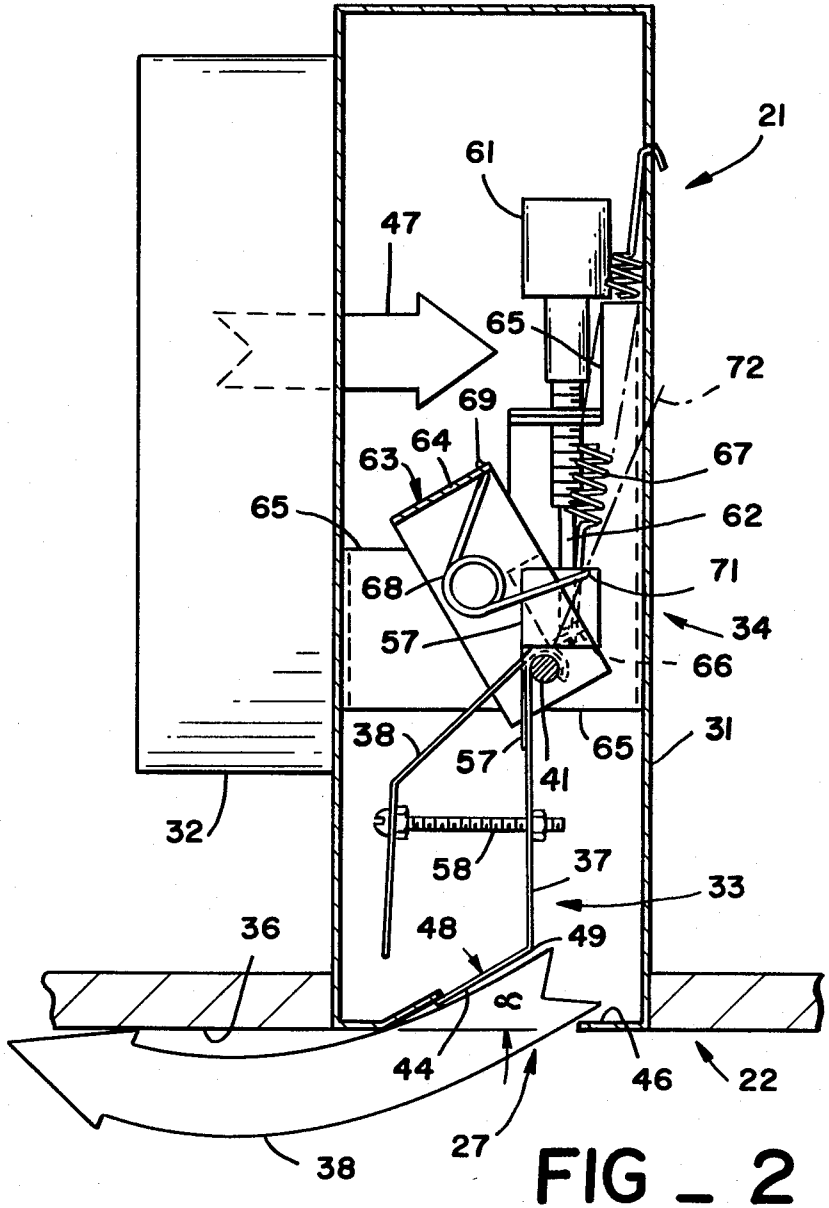
FIG. 2 is an enlarged, end elevational view, in cross-section, of the diffuser of FIG. 1 with the blades in position for discharge of air during a cooling mode.

Blade means 33, is preferably formed for discharge of air from outlet 27 primarily along one side of the blade means at a first angle of discharge. Preferably this angle of discharge produces a Coanda effect flow of the discharged air along surface 36 of ceiling 22. Positioning of blade means 33 in the first position is shown in FIG. 2, and the air discharged can be seen to pass along the outside of a first or cool blade 37 and along housing wall 48 and out through outlet 27 in the manner shown by arrow 38. The acute angle $\alpha$ with respect to ceiling surface 36 and the substantially continuous transition of housing wall 48 from blade 37 to surface 36 causes stream 38 of the air to adhere to or hug the ceiling surface 36 so that the air will be distributed further along the surface before diffusing from the stream 38 and sinking into the room. As long as the acute angle $\alpha$ is less than 35 to 40 degrees, and preferably less than about 30 degrees, and one of blade 37 and wall 48 makes a substantially continuous transition to surface 36, stream 38 will tend to remain adhered or attached to ceiling surface 36 in a true Coanda effect.

Figure 3:
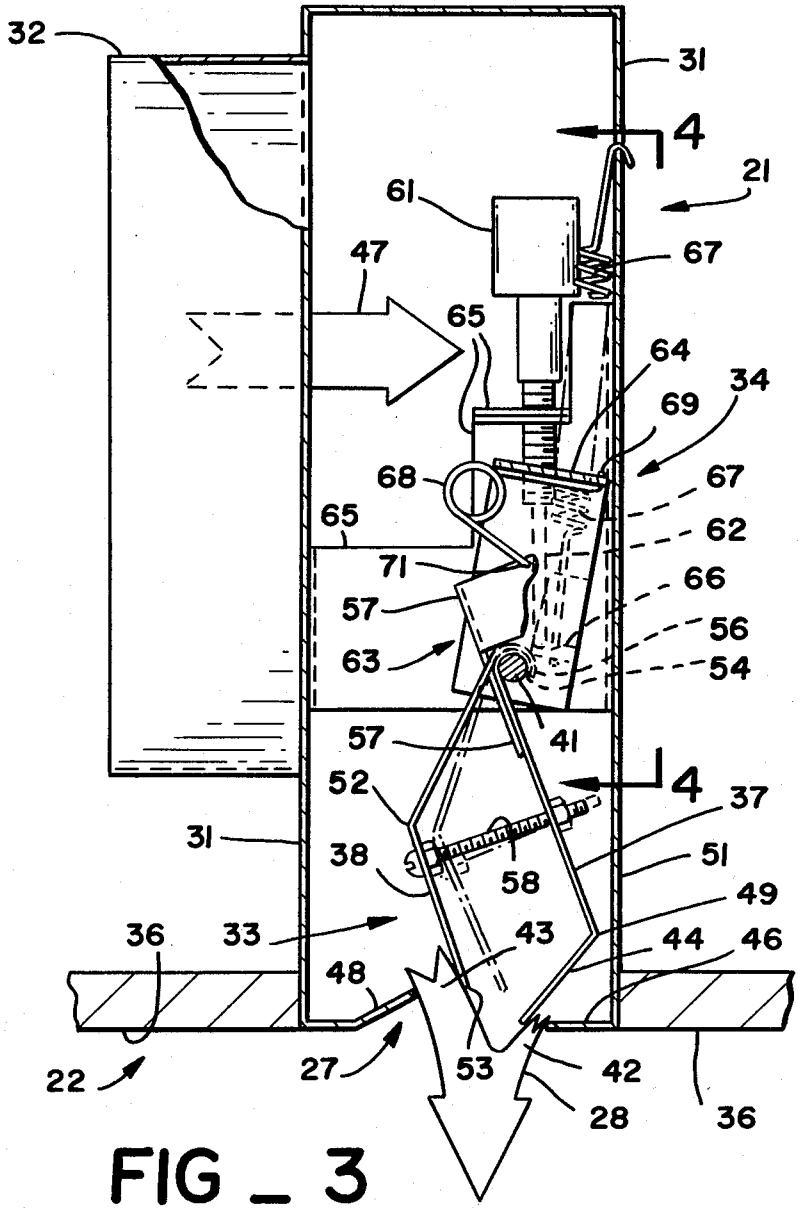
FIG. 3 is an end elevational view, in cross-section, corresponding to FIG. 2 with the blades in position for discharge of air in a heating mode.

Additionally, however, the improved diffuser of the present invention includes blade means 33 which is formed for discharge of air along an opposite side of the blade means at a second angle of discharge displaced from the first angle of discharge. Most preferably the second angle of discharge is selected to produce a flow of air detached from surface 36. The second discharge pattern and the position of blade means 33 to produce the same is shown in FIG. 3. A stream of air 28 is being discharged primarily along the outside of second blade 38 through outlet 27. The blade means in FIG. 3 will be seen to be angularly displaced or pivoted about longitudinally extending blade support rod 41 from the position of FIG. 2.

The direction of discharge of stream 28 shown in FIGS. 1 and 3 is most advantageously used when the diffuser is in a heating mode so that a detached stream of air 28 can be directed down along the wall 23 and windows 24 of the structure. In order to achieve a detached, generally vertically oriented stream 28, it is preferable that some air be discharged along the outside of the first or cool blade 37, as indicated by air stream portion 42, but the majority or primary supply of air is discharged along the outside of hot blade 38, as indicated by air stream portion 43. The portion 42 being discharged from outlet 27 tends to provide a lateral component to the stream which resists the opposed lateral component in stream portion 43.

As will be appreciated, the angular orientation of the resultant stream 28 can be altered by formation of blade means 33 in a manner so as to vary the amount of air discharged along the respective sides of blade means 33. The discharge of a high volume of air along blade 37 is not required in order to prevent the hot air discharged along blade 38 from being undesirably horizontally directed (too much to the right as viewed in FIG. 3).

In order to provide the desired change-over flow pattern of air discharged from the diffuser 21, blade means 33 is preferably formed by a pair of longitudinally extending, relatively spaced-apart blades 37 and 38 having distal ends oriented to produce the desired flow pattern in the first and second position. This can be accomplished with respect to the cold blade 37 by forming the distal end of the blade with a ramp portion 44 which will be positioned approximate outlet 27 on a side of the outlet opposite housing wall 46 defining one side of outlet 27. Air entering diffuser housing 31, as indicated by arrow 47, will pass downwardly to the diffuser and along the outside of cold blade 37 until it impacts horizontally extending housing wall 46. Wall 46 induces a horizontal component in the air discharged which cooperates with ramp portion 44 of the cold blade to produce a Coanda flow for stream 38 along ceiling surface 36. As above noted, the angle $\alpha$ of ramp portion 44 with respect to ceiling surface 36 is preferably not greater than about 40 degrees and most preferably is about 30 degrees.

In the preferred form, housing 31 is also provided with a ramp wall 48 against which ramp portion 44 of cold blade 37 rests or mates when the blade assembly is in the first position of FIG. 2. Ramp wall 48 extends inwardly of the housing at about the same angle as ramp portion 44 so as to overlap and support the distol end of cold blade 37 when in the first position and to provide an extension of ramp 44 to enhance the discharge of air in a stream which will produce a true Coanda effect. An insulating strip (not shown) can be mounted between ramp wall 48 and blade ramp portion 44 to reduce noise during the change-over and prevent noise from air discharging from between the blade and the ramp. Any such insulation strip is preferably not more than about 1/16 inch thick or else there will be a step at the overlap between the blade and housing which will interfere with the Coanda effect and tend to detach stream 38.

As shown in the drawing, cold blade 37 is comprised of two angularly related portions, but it will be appreciated that it would be possible to form blade 37 with an arcuate section connecting ramp 44 to the main body of blade 37. The angular longitudinally extending knee 49, therefor, is primarily provided as a matter of convenience of manufacturing and could be replaced by a continuous arcuate section. Knee 49 can, however, have a throttling or flow control effect with side wall 51 of housing 31 when blade 37 is in the second position, as shown in FIG. 3.

Second blade or hot blade 38 is also preferably formed with a longitudinally extending knee portion 52 that optionally can be replaced by an arcuate section. The essential aspect of form of blade 38 is that it define an opening with inward ramp wall 48 which is oriented for discharge of air from outlet 27 in a manner producing a detached stream 28. Thus, the orientation of the section of the blade proximate distal end 53 with respect to the edge of ramp wall 48 is determinative of the direction or flow of the main portion 43 of the discharged stream. The auxiliary opening between wall 46 and cold blade ramp portion 44 also effects the eventual direction of the stream 28, as described above.

It is preferable that blades 37 and 28 are both mounted for pivotal movement about rod 41 by simply forming the ends 54 and 56 thereof to wrap around rod 41. Fixedly mounted to cold blade 37 is a tab member 57 which is used to impart angular displacement of blade 37 in a manner which will be more completely discribed hereinafter. Blade 38 is secured for movement in fixed relation to blade 37 by fastener 58 so that upon displacement of first blade 37 the second blade 38 follows the angular displacement so that the blades move together as a unit.

In order to permit selective adjustment of the angle between the blades as they move as a unit, it is preferable to provide adjustment means which can be a fastener 58 or powered adjustment means, such as thermal, electrical, pneumatic or hydraulic actuator that permits blade 38 to be moved toward or displaced away from blade 37, as indicated in FIG. 3 in dotted lines. As will be seen from FIG. 3, such relative adjustment of blades 37 and 38 allows the distance ramp wall 48 and distal end 53 of the hot blade to be adjusted, which will enable control of the volume of air discharged in the second position or heating mode. While the change in the volume of air discharged in the heating mode by adjustment of blade 38 will effect in some small amount the angle of discharge, the effect is small since a relatively minor discharge of air through the auxiliary opening between wall 46 and blade ramp 44 will be sufficient to prevent too great a lateral component in stream 28. It should be noted that it would also be possible to drive the blade means of the present invention off of second blade 38 and adjust the first blade with respect to the second blade.

As thus far described, the air distribution apparatus or diffuser of the present invention can be used merely as a distribution device for air, regardless of temperature and regardless of the manner of driving or displacing the blades. As indicated, however, it is primarily intended for use to effect both heating and cooling. While electrical, pneumatic and hydraulic blade displacement means 34 can be employed in connection with heating and cooling, a further advantage of the present invention is to power the diffuser by a thermally actuated displacement means 34. Moreover, it is most preferable that the thermally-powered actuator include a rapid change-over assembly that will cause rapid angular displacement of blade means 33 between the first and second positions, although it will be understood that rapid change-over assemblies can also be employed in electrical, pneumatic and hydraulic systems.

Blade displacement means 34 includes thermal actuator element 61 mounted on bracket 65 in which there is a substance that expands and contracts with changes in ambient temperature. This expansion and contraction is used to drive a piston or pushrod 62. Such thermal sensor-actuators are used extensively in the automotive industry and in connection with diffusers of the type in U.S. Pat. No. Re. 30,953 and are well known in the industry and available through several manufacturers. Pushrod 62 of the thermal actuator is used to drive blade means 33 directly or underneath through a rapid change-over assembly, generally designated 63. Thus, in coming air 47 impinges upon and heats or cools actuator 61 so as to either extend or contract pushrod 62 and thereby drive the blade means directly or through the rapid change-over assembly.

Under some conditions, usually low temperature conditions, thermal actuator devices may respond somewhat slowly to changes in the temperature of the supply air in the housing. It is preferable, therefore, that, for such applications and generally, the diffuser include a rapid change-over assembly that will cascade and cause substantially instantaneous changing of the blade means between the first and second positions. It is possible to drive blade means 33 directly from the pushrod 62 of thermal actuator 61, but the relatively slow displacement between the two positions would cause air to be discharged in a stream that gradually varies from vertical to horizontal, or the reverse. In the intermediate positions, air would be directed at an angle out into the room and may be directed on personnel or blow papers and the like on room furniture. In some applications, of course, the slow change-over between positions is not a disadvantage and at high temperatures the change-over will be relatively quickly accomplished, but in many installations, for example offices, it is most desirable to be able to shift rapidly between heating and cooling.

The rapid change-over assembly 63 can take several forms, but as shown in the drawing, it includes an inverted, U-shaped, displaceable first member 64 having an L-shaped flange or bracket portion 66 secured thereto which is engaged by pushrod 62 of thermal actuator 61. The first member is mounted for pivotal movement on transverse support rod 41, and the flange 66 is engaged by pushrod 62 in the manner slightly displaced from the center of rod 41 so as to induce a turning moment in member 64 about the rod. Downward movement of rod 62, therefore, will tend to rotate first member 64 in a clockwise direction about rod 41, as viewed in FIGS. 2 and 3. Also coupled to first member 64 is return spring means 67, for example by coupling the return spring to L-shaped flange or bracket 66. Thus, the return spring tends to oppose displacement by pushrod 62 and maintains the flange of the first member in contact with the pushrod so that rotation of first member 64 in a counter-clockwise direction about rod 41 occurs when pushrod 62 is retracted and return spring 67 causes flange 66 to follow the pushrod.

First displaceable member 64 is not directly coupled to blade assembly 33. Instead, it is coupled through flip spring means 68 to a second element, namely, tab member 57, mounted fixedly to first blade 37. Flip spring 68 is preferably in the form of a loop spring having an end 69 secured to the first element and an end 71 secured to second member 57. Upon displacement of the first member so that end 69 crosses over a predetermined line, namely line 72 between end 71 and the center of rod 41, the flip spring will produce rapid displacement of member 57 between the first and second positions.

In operation, therefore, the rapid change-over mechanism shifts from the first position of FIG. 2 to the second position of FIG. 3 in the following manner. Pushrod 62 is downwardly displaced as warm air stream 47 heats thermal actuator 61. The displacement in turn urges flange 66 and first member 64 to pivot clockwise around rod 41. When the end 69 of flip spring 68 passes over line 72, first member 57 is rapidly snapped or pivoted in a counter-clockwise direction to flip the blade assembly to the second position of FIG. 3. As long as warm air is maintained in housing 31, the thermal actuator pushrod 62 will be extended and maintained in assembly in the second position.

Upon the introduction of a cold air stream 47 into housing 31, for example, as a result of a command by thermostat means (not shown), thermal actuator 61 will start to retract pushrod 62. As the pushrod is retracted, return spring 67 will pull flange 66 upwardly against the pushrod and cause first elements 64 to rotate in a counter-clockwise direction. As the end of 69 passes over line 72, the flip spring will immediately force second member 57 in a clockwise direction to shift the blade assembly back to the first position of FIG. 2.

As will be seen, therefore, the geometry of the flip spring and location of flip or change-over line 72 can be selected so that change-over occurs at the desired temperature level upon heating and cooling. For example, such change-over occurs when the temperature within housing 31 reaches 84 degrees F. when changing from cooling to heating and at about 68 degrees F. when changing from heating to cooling.

The thermally-powered, change-over diffuser of the present invention, therefore, not only is suitable for heating and cooling, but automatically effects a change in the direction of discharge of air from diffuser when the mode of heating or cooling is changed. Additionally, the change-over is rapidly effected so as to enable use of the diffuser in a wide variety of applications without disruptive and undesirable air discharge patterns.

We claim:

1. A change-over diffuser including a housing formed for coupling to air supply means and formed with outlet means for discharge of air therefrom, blade means movably mounted with respect to said housing, and blade displacement means coupled to said blade means for displacement of said blade means between a first position and a second position for control of air discharged from said outlet means, wherein the improvement in said change-over diffuser comprises:

said blade displacement means being provided as an expansible thermal sensor-actuator element coupled to drive said blade means and being positioned inside said housing for displacement of said blade means in response to the temperature of the air supplied to said housing;

said blade means being formed for the discharge of air from said outlet means when said blade is in said first position at a first angle of discharge;

said blade means being formed for the discharge of air from said outlet means when said blade means is in said second position at a second angle of discharge angularly displaced from said first angle of discharge; and said displacement means further includes a snap-acting assembly coupled between said thermal sensor-actuator element and said blade means and formed for snap-acting displacement of said blade means between said first position and said second position in response to expansion and contraction of said thermal sensor-actuator element upon changes of temperature in said housing.

2. A change-over diffuser as defined in claim 1 wherein, said blade means is provided by a pair of blades both of which are mounted for movement as a unit, and said blades and said housing are cooperatively formed for the discharge of the majority of the volume of air along a first of said blades in said first position at an angle with respect to a surface proximate said housing producing Coanda effect flow of air along said surface, and said blades being formed for the discharge of the majority of the volume of air along a second of said blades in said second position in a stream of air detached from said surface.

3. A change-over diffuser as defined in claim 2 wherein, both of said blades are pivotally mounted to said housing, one of said blades is displaced by said displacement means, a remainder of said blades is secured for movement in fixed relation to said one of said blades, and adjustment means formed and mounted for adjustment of the angle between said blades to permit adjustment of the size of the discharge opening of said outlet means in at least one of said first position and said second position.

4. A change-over diffuser as defined in claim 1 wherein, said snap-acting assembly includes a displaceable first element mounted in engagement with said thermal sensor-actuator element, return spring biasing means formed to bias said first element toward engagement with said thermal sensor-actuator element, a displaceable second element secured to said blade means for displacement thereof, and flip spring means coupling said first element to said second element at locations producing snap-acting displacement of said second element by said flip spring means in opposite directions upon displacement of said first element across a predetermined line by said thermal sensor-actuator element.

* * * * *